US006581812B2

(12) United States Patent
Roscoe-Dare

(10) Patent No.: US 6,581,812 B2
(45) Date of Patent: Jun. 24, 2003

(54) ERGONOMIC GUITAR STRAP

(76) Inventor: Troy Kenneth Roscoe-Dare, 1 Crab Apple Ridge Rd., Randolph, VT (US) 05060

( * ) Notice: Subject to any disclaimer, the term of this patent is extended or adjusted under 35 U.S.C. 154(b) by 12 days.

(21) Appl. No.: 09/752,987

(22) Filed: Jan. 2, 2001

(65) Prior Publication Data

US 2002/0084296 A1 Jul. 4, 2002

(51) Int. Cl.[7] ..... A45F 3/04

(52) U.S. Cl. ..... 224/259; 84/327; 224/257; 224/258; 224/607; 224/608; 224/910

(58) Field of Search ..... 224/259, 257, 224/258, 260, 600, 606, 623, 624, 627, 910, 150, 608; 84/327

(56) References Cited

U.S. PATENT DOCUMENTS

| | | | | | |
|---|---|---|---|---|---|
| 3,098,591 | A | * | 7/1963 | LeRude | 224/150 |
| 3,655,106 | A | * | 4/1972 | Wojcinski | 224/150 |
| 4,254,901 | A | | 3/1981 | McIntosh | |
| D306,871 | S | * | 3/1990 | Bracy | 224/259 |
| 5,215,239 | A | * | 6/1993 | Walters, Jr. | 224/259 |
| 5,282,558 | A | * | 2/1994 | Martinez | 224/150 |
| 5,358,160 | A | * | 10/1994 | Bianchi | 224/192 |
| 5,433,360 | A | * | 7/1995 | Rock | 224/150 |
| 5,772,091 | A | * | 6/1998 | Lackner | 224/149 |
| 5,873,503 | A | * | 2/1999 | Atherton et al. | 224/259 |
| 6,068,167 | A | * | 5/2000 | Hopson | 224/150 |
| 6,199,731 | B1 | * | 3/2001 | Lehoux | 224/150 |
| 6,325,258 | B1 | * | 12/2001 | Verdugo et al. | 224/149 |

* cited by examiner

*Primary Examiner*—Stephen W. Cronin
*Assistant Examiner*—Maerena W. Brevard
(74) *Attorney, Agent, or Firm*—James M. Leas

(57) ABSTRACT

A dual shoulder guitar strap, has two straps. Each goes over one shoulder. The strap has length adjustment buckles for each of these straps. The strap also has a device for adjusting position of each strap on its shoulder. Length adjustments and position on shoulder adjustments are independently controllable. One strap can lie flat on the other so the strap can be used either to hold the guitar over one shoulder or to hold the guitar supported by both shoulders.

28 Claims, 5 Drawing Sheets

ERGONOMIC GUITAR STRAP

FIELD OF THE INVENTION

This invention generally relates to straps for holding a guitar or other object. More particularly the invention relates to a strap that extends over both shoulders of a guitar player.

BACKGROUND OF THE INVENTION

Standard guitar straps extend over one shoulder and put all the weight of the guitar on that one shoulder. This can be a serious problem for shoulder, neck, and back after several hours of playing. U.S. Pat. No. 4,254,901 to McIntosh describes a double shouldered guitar strap that shares the weight of the guitar on both shoulders. However, the McIntosh strap has a connection bracket for the two shoulder straps that provides a fixed angle between these straps, so the straps lie in one fixed position on the shoulders. Another dual shoulder strap for playing various instruments is presently offered for sale at Slider-straps.com. These straps are configured similar to a back pack with straps extending both over and under the arms. Neither strap offers a way to adjust position of the strap on the shoulders. Both the McIntosh strap and the Slider-strap are restricted in the range of configurations in which they can be used; for example, neither can be used as a traditional guitar strap over one shoulder. Thus a better design that permits adjusting the location of the straps on the shoulders is needed and that allows the strap to be used either on one shoulder or both shoulders while providing easy adjustment of length and position on the shoulders, and this solution is provided by the following invention.

SUMMARY OF THE INVENTION

It is therefore an object of the present invention to provide a guitar strap for supporting a guitar on two shoulders that has easy adjustments for both strap length and strap position on the shoulders;

It is a further object of the present invention to provide a deflection adjuster that permits adjusting the angle between the straps to permit control of location of the straps on the shoulders;

It is a further object of the present invention to provide a strap that can be used either as a dual shoulder strap or as a standard guitar strap on one shoulder;

It is a feature of the present invention to provide the slidable deflection adjuster has a locking mechanism to hold it in a fixed position when weight is applied;

It is a further feature of the present invention that the deflection adjuster has teeth that allow movement when no weight is provided and that restrict movement when weight is applied;

It is an advantage of the present invention that the strap can be used either as a dual shoulder strap or as a familiar single shoulder strap; and It is a further advantage of the present invention that the strap can be adjusted quickly while being worn.

These and other objects, features, and advantages of the invention are accomplished by a shoulder strap that can be used to support an object on both shoulders. The dual shoulder strap has a first strap and a second strap. The first strap is for placing over a first shoulder of a person wearing the strap and it has a first length adjustment buckle. The second strap is for placing over a second shoulder of the person, and it has a second length adjustment buckle. The dual shoulder strap also has a device for adjusting position of the first strap on the first shoulder and position of the second strap on the second shoulder. The length adjustments and the position adjustments are independently controllable.

Another aspect of the invention is accomplished by a shoulder strap comprising a first strap and a second strap. The first strap has a first end piece, a second end piece, and a center portion between the first end piece and the second end piece. The second strap has a third end piece and a fourth end piece. The third end piece is connected to the center portion of the first strap. The fourth end piece is pivotably connected to the first end piece. The second strap can lie flat directly on the first strap. The shoulder strap can be worn either as a standard strap with both the first strap and the second strap extending over one shoulder or the shoulder strap can be worn as a dual shoulder strap having the first strap extending over one shoulder and the second strap extending over the other shoulder.

BRIEF DESCRIPTION OF THE DRAWINGS

The foregoing and other objects, features, and advantages of the invention will be apparent from the following detailed description of the invention, as illustrated in the accompanying drawings, in which.

DETAILED DESCRIPTION OF THE INVENTION

The present invention is a guitar strap that can be worn either on both shoulders or on one shoulder. From the point of view of the player a strap extends over each shoulder, and these two straps are linked together in front near where the strap connects to the guitar. The two straps are also joined together along the guitar player's back at a deflection buckle that controls the position of the two straps on the player's shoulders. Both ends of the guitar strap have connectors for connecting to the guitar. The length of the guitar strap and the position of the straps on the shoulders can be easily and independently adjusted with separate buckles. Strap length can be adjusted using buckles on each of the straps where they extend in front of the guitar player. Shoulder position is adjusted by raising or lowering the deflection buckle. The deflection buckle does not effect strap length.

Figure 1:
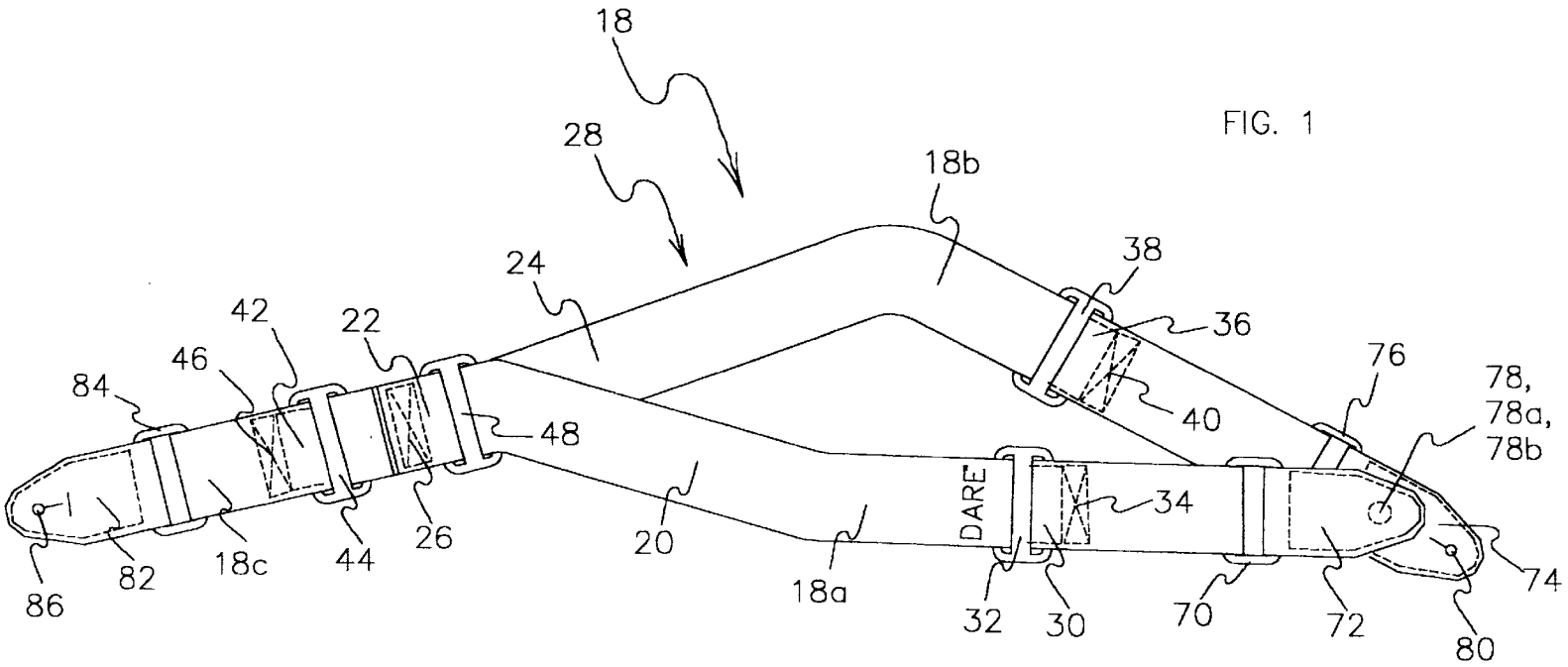
FIG. 1 is a top view of a guitar strap of the present invention with the straps spread apart for wearing one on each shoulder.
Figure 2:
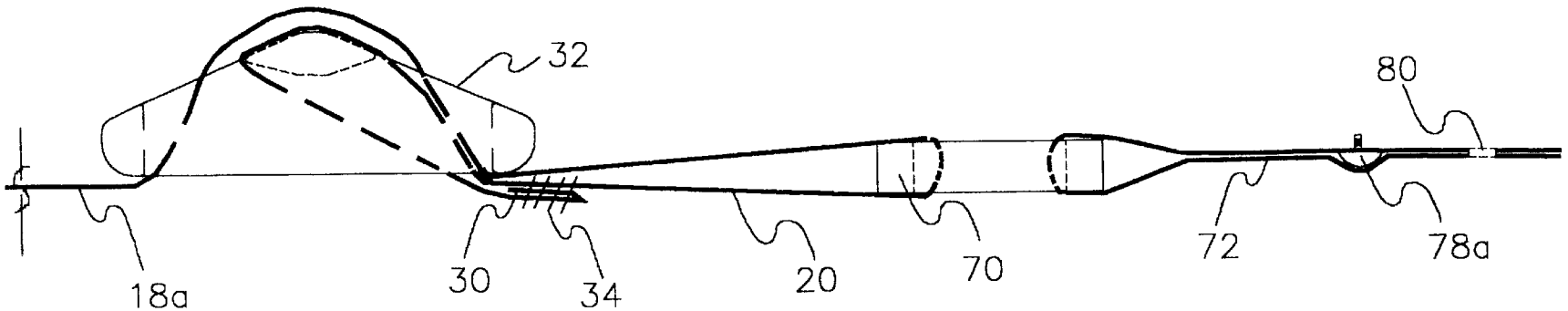
FIG. 2 is a cross sectional view of the length adjustment buckle and single slot buckle, strap, showing how a strap extends through slots of the length adjustment buckle, and showing an end piece and its pivoting connector.

Dual guitar strap 18 includes short strap 20 having end 22 sewn to long strap 24 with stitches 26 along center region 28 of long strap 24, as shown in FIG. 1. Short strap 20 has end 30 sewn to connect it to buckle 32 with stitches 34, as shown in FIGS. 1 and 2. Long strap 24 has end 36 sewn to connect it to buckle 38 with stitches 40. Long strap 24 also has end 42 sewn to connect it to buckle 44 with stitches 46. Besides sewing, other connectors can be used, such as velcro, rivets, or staples.

Figure 3A:
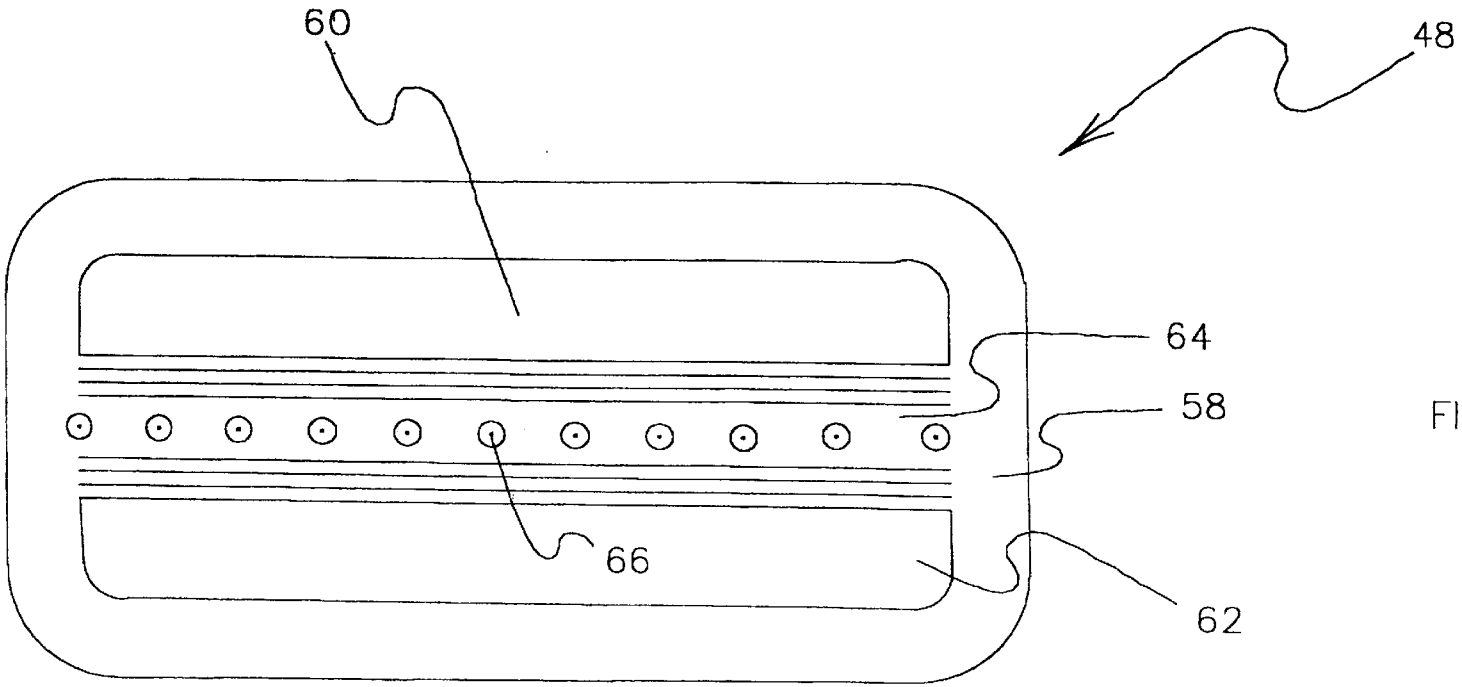
FIG. 3*a* is a top view of a deflection buckle.
Figure 3B:
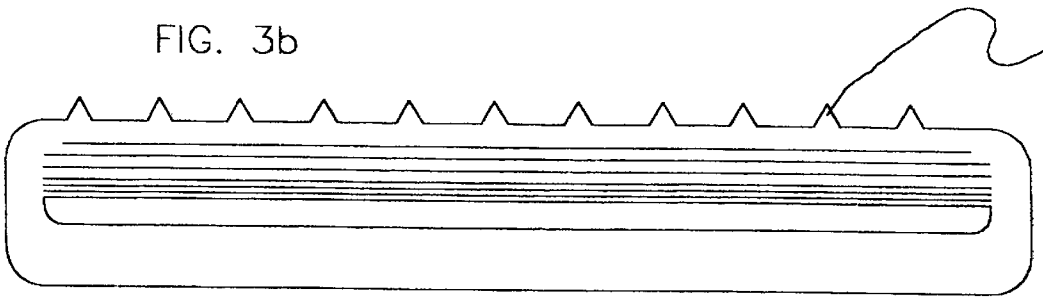
FIG. 3*b* is a cross sectional view of the deflection buckle of FIG. 2*a;*
Figure 3C:
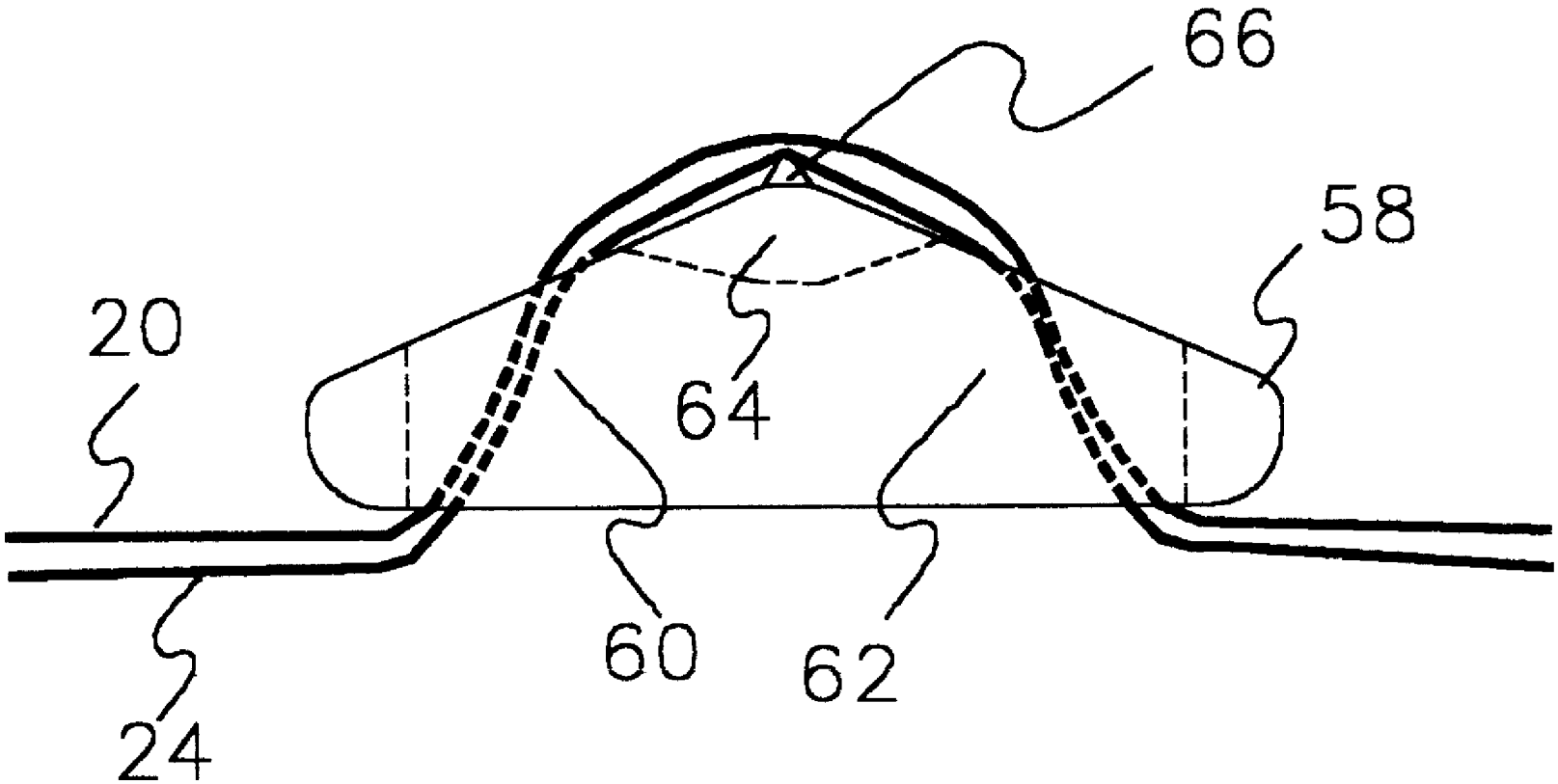
FIG. 3*c* is a cross sectional view of the deflection buckle of FIG. 2*a* taken perpendicular to the cross sectional view of FIG. 2*b* and showing a strap extending through slots of the buckle.

Both short strap 20 and long strap 24 extend through deflection buckle 48 which is further illustrated in FIGS. 3*a*–3*c*. Deflection buckle 48 is formed of single plastic piece 58 having slot 60 and slot 62. Bar 64, which extends between slot 60 and slot 62, has teeth 66 that serve as a locking mechanism to engage into long strap 24 when force is applied to stretch strap 24 against teeth 66. Thus, straps 20 and 24 can slide through deflection buckle 48 when teeth 66 are not engaged, as when no force is applied stretching the strap. But when a weight, such as a guitar, is hanging from guitar strap 18, teeth 66 engage in the fabric of strap 24, preventing any other movement. Thus, the position of deflection buckle 48 can be easily adjusted by sliding deflection buckle 48 along straps 20, 24 when guitar strap 18 is not supporting the guitar, but further movement is prevented during use of guitar strap 18 by the weight of the guitar.

Figure 4:
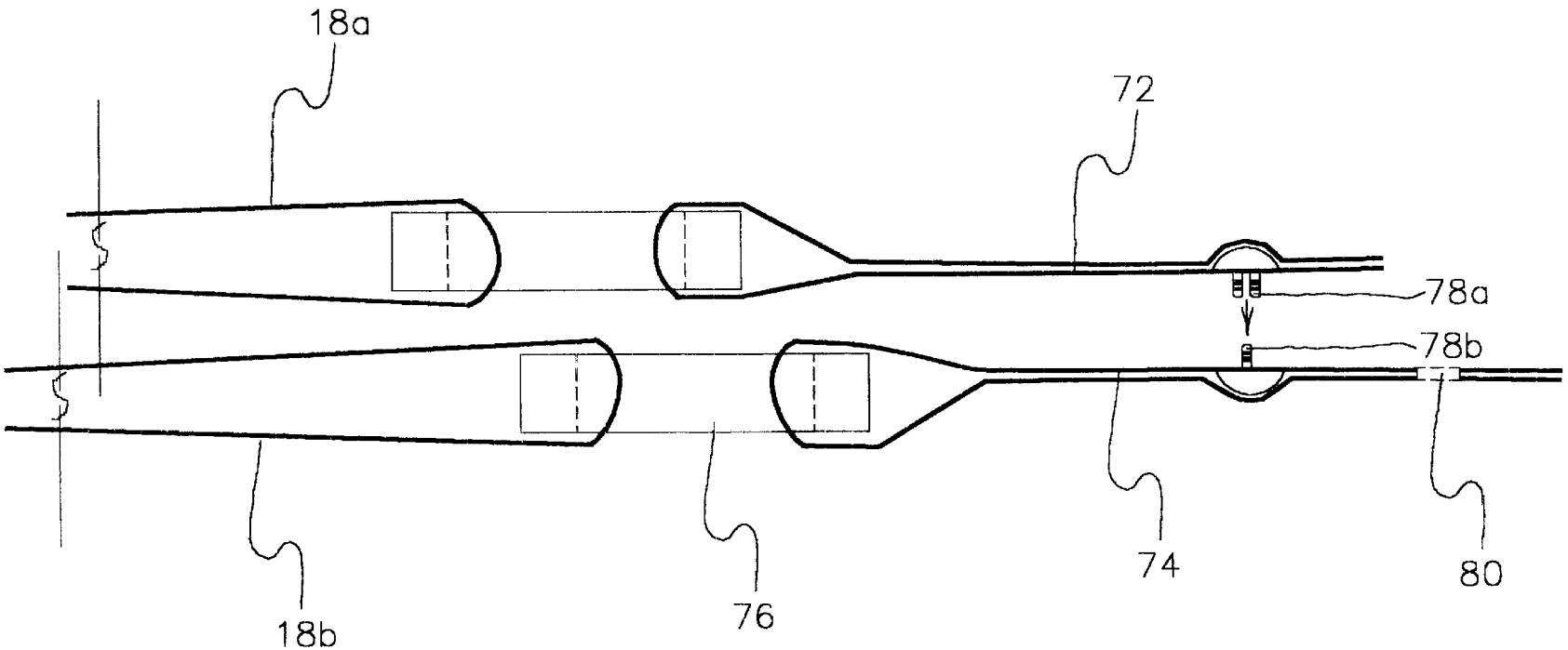
FIG. 4 is a cross sectional view of pivotal connectors and showing connection between straps and end pieces through single slot buckles.

Short strap 20 and d piece 72 of guitar strap 18 both extend through single slot buckle 70. Long strap 24 d end piece 74 both extend through single slot buckle 76. End piece 72 includes pivoting connector 78*a* for connecting to corresponding pivoting connector 78*b* on end piece 74, as shown in FIG. 4. Preferably pivoting connector 78*a* is of a type that can be connected and disconnected quickly and that allows free pivotal motion, such as a ratcheting rivet. End piece 74 also includes hole 80 for connecting front swaps 18*a*, 18*b* to a guitar. At the opposite end of long strap 24, end piece 82 and strap 24 both extend through single slot buckle 84. End piece 82 has hole 86 for connecting back guitar strap 18*c* to the guitar. As an alternative to holes 80 and 86, standard guitar connectors can be fitted for connecting end pieces 74 and 82 to the guitar.

When deflection buckle 48 is moved toward end straps 72, 74 straps 18*a*, 18*b* are pulled closer together, so guitar strap 18 will lie on shoulders closer to the neck of the player. When deflection buckle 48 is moved toward end piece 82, straps 18*a*, 18*b* can move more widely apart, so guitar strap 18 can lie further out on the shoulders of the player. Adjusting deflection buckle 48 has no effect on the overall length of guitar strap 18; it just adjusts the position of straps 18*a*, 18*b* on the shoulders of the player.

Deflection of straps 18*a*, 18*b* for shoulder positioning is facilitated by pivoting connector 78 which allows the angle between straps 18*a*, 18*b* to vary without stress on connector 78. But deflection buckle 48 has no pivoting connector, and stress where straps 20 and 24 emerge from pivoting connector provides a force moving straps 20, 24 toward each other. That stress is reduced when deflection buckle 48 is moved toward end piece 82, so straps 20 and 24 can move further apart with a smaller angle there between and with less stress forcing them back.

When buckles 32, 38 are moved toward end pieces 72, 74, guitar strap 18 becomes longer, as shown in FIG. 2. Similarly buckle 84 can also be used to make guitar strap 18 longer by moving buckle 44 toward end piece 82. Buckles 32 and 38 can be adjusted either when the strap is disconnected from the guitar or when the player is wearing the strap.

Thus, adjustment of strap length involves buckles 32, 38, and 82, all independent of deflection buckle 48. Adjustment of the position of straps 18*a*, 18*b* on shoulders of the player is exclusively controlled by deflection buckle 48.

Figure 5:
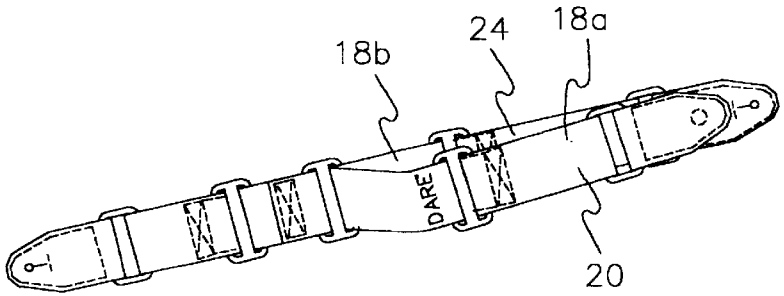
FIG. 5 is a top view of the guitar strap of FIG. 1 with one strap overlapping another for wearing on only one shoulder.

In addition to being used as a dual shoulder strap, guitar strap 18 can also be used as a traditional single shoulder strap, as shown in FIG. 5, since strap 20 can lie flat directly on top of strap 24. At one end short strap 20 has end 22 sewn to center portion 28 of long strap 24, and end pieces 72 and 74 are pivotably connected to each other, facilitating flat overlapping of the two straps for this purpose.

While several embodiments of the invention, together with modifications thereof, have been described in detail herein and illustrated in the accompanying drawings, it will be evident that various further modifications are possible without departing from the scope of the invention. For example the dual shoulder strap of the present invention can be used to support other musical instruments, such as mandolin, banjo, saxaphone, or drum. It can also be used to support a suitcase, briefcase, or other objects. Nothing in the above specification is intended to limit the invention more narrowly than the appended claims. The examples given are intended only to be illustrative rather than exclusive.

What is claimed is:

1. A dual shoulder strap, comprising a first strap and a second strap, said first strap having a first end, a second end, and a center portion between said first end and said second end, said second strap having a third end and a fourth end, said third end connected to said center portion of said first strap, said fourth end pivotably connected to said first end of said first strap, said first strap for placing over a first shoulder and having a first length adjustment mechanism, said second strap for placing over a second shoulder and having a second length adjustment mechanism, said dual shoulder strap further comprising a device mounted on said firs strap and on said second strap, said device for adjusting position of said first trap on the first shoulder and position of said second strap on the second shoulder, wherein said strap length adjustments and said shoulder position adjustment independently controllable, wherein said device for adjusting position of straps on shoulders comprises a slidable buckle, wherein said first strap and said second strap extend through said slidable buckle, and wherein position of said slidable buckle on said first and said second straps determines an angle there between.

2. The dual shoulder strap as recited in claim 1, wherein said first length adjustment mechanism comprises a first length adjustment buckle and said second length adjustment mechanism comprises a second length adjustment buckle.

3. The dual shoulder strap as recited in claim 2, wherein said first length adjustment buckle is adjacent an end of said first strap and said second length adjustment buckle is adjacent an end of said second strap.

4. The dual shoulder strap as recited in claim 1, wherein said slidable buckle comprises a locking mechanism to restrict sliding when a force stretches said first strap or sail second strap.

5. The dual shoulder strap as recited in claim 4, wherein said locking mechanism comprises teeth on said buckle.

6. The dual shoulder strap as recited in claim 1, wherein said shoulder position adjustments are made by sliding said slidable buckle.

7. The dual shoulder strap as recited in claim 1, wherein said first strap and said second strap extend through said slidable buckle in the same path and one on the other.

8. The dual shoulder strap as recited in claim 1, wherein said slidable buckle serves only to adjust strap position on shoulders and does not affect strap length.

9. The dual shoulder strap as recited in claim 1, wherein said first strap is longer than said second strap and wherein said second strap can lie flat directly on said first strap.

10. The dual shoulder strap as recited in claim 9, wherein said strap can be used over a single shoulder by providing both said first strap and said second strap over the single shoulder.

11. The dual shoulder strap as recited in claim 1, wherein said first end piece or said third end piece has a mechanism for connecting to a device to be carried byte strap.

12. A dual odder strap, comprising a first strep and a second strap, said first strap having a first end, a second end, and a center portion between said first end and said second end, said second strap having a third end and a fourth end, said third end connected to said center portion of said first strap, said fourth end pivotably connected to said first end of said first strap, said first strap for placing over a first should and having a first length adjustment mechanism, said second strap for placing over a second shoulder and having a second length adjustment mechanism, said dual shoulder strap further comprising a shoulder position adjustment device mounted on said first strap and on said second strap, said device for adjusting the position of said first strap on the first shoulder and position of said second strap on the second shoulder, wherein said strap length adjustment mechanism and said shoulder position adjustment are independently controllable, wherein said first strap has a first end piece and a second end piece and said second strap has a third end piece, wherein said third end piece is connected to said first end piece, wherein said first and second end pieces a e connected to said first strap with buckles and said third end piece is connected said second strap with a buckle.

13. The dual shoulder strap as recited in claim 12, wherein said strap further comprises a pivoting connector for connecting said third end piece to said first end piece.

14. The dual shoulder strap as recited in claim 1, further comprising a third length adjustment mechanism connected to said first strap.

15. The dual shoulder strap as recited in claim 1, wherein said length adjustment can be made while wearing the strap.

16. The dual shoulder strap as recited in claim 1, further comprising a guitar, other musical instrument, briefcase, suitcase or other object connected to said strap.

17. A shoulder strap, comprising a first strap and a second strap, said first strap having a first end, a second end, and a center portion between said first end and said second end, said second strap having at third end and a fourth end, said third end connected said center portion of said first strap, said fourth end pivotably connected to said first end of said first strap, wherein said second strap can lie flat directly on said first strap, wherein said shoulder strap can be worn either as a standard strap with both said first strap and said second strap extending over one shoulder o said shoulder strap can be worn as a dual shoulder strap having said first extending over a first shoulder and said second strap extending over a second shoulder, further comprising a device for adjusting position of said strap on the first shoulder and position of said second strap on the second shoulder, wherein said device comprises a slidable buckle, wherein said first strap and second strap extend through said slidable buckle, and wherein position of said slidable buckle on said first and said second straps determines an angle there between.

18. The shoulder strap as recited in claim 17, wherein said slidable buckle comprises a locking mechanism to restrict sliding when weight is on the strap.

19. The shoulder strap as recited in claim 18, wherein said locking mechanism comprises teeth on said buckle.

20. The shoulder strap as recited in claim 17, wherein said first strap and said second strap extend through said slidable buckle in the same path and one on the other.

21. The shoulder strap as recited in claim 17, wherein said slidable buckle serves only to adjust position on shoulders and does not affect strap length.

22. The shoulder strap as recited in claim 17, further comprising a device to provide length adjustments.

23. The shoulder strap as recited in claim 22, wherein said device to provide length adjustments and said position on shoulder adjustments are independently controllable.

24. The shoulder strap as recited in claim 22, further comprising a first length adjustment buckle and a second length adjustment buckle, wherein said first length adjustment buckle is adjacent a sewn end of said first strap and said second length adjustment buckle is adjacent a sewn end of said second strap.

25. The shoulder strap as recited in claim 17, wherein an end piece of said second strap is connected to an end piece of said first strap.

26. The shoulder strap as recited in claim 17, wherein said length adjustment can be made while wearing the strap.

27. The shoulder strap as recited in claim 17, further comprising a guitar, other musical instrument, briefcase, suitcase or other object connected to said strap.

28. A dual shoulder strap, comprising a first strap and a second strap, said first strap having a first end, a second end, and a center portion between said first end and said second end, said second strap having a third end and a fourth end, said third end connected to said first end of said first strap, said first strap for placing over a first shoulder and having a first length adjustment mechanism, said second strap for placing over a second shoulder and having a second length adjustment mechanism, said dual shoulder strap further comprising a device mounted on said first strap and on said second strap, said device for adjusting position of the first strap on the first shoulder and position of said second strap on the second shoulder wherein said strap length adjustments and said shoulder position adjustment are independently controllable, wherein said device for adjusting position of straps on shoulders comprises a locking mechanism, wherein position of said device on said first and second straps determine an angle there between.

* * * * *